US007650758B2

(12) United States Patent
Thybo

(10) Patent No.: US 7,650,758 B2
(45) Date of Patent: Jan. 26, 2010

(54) METHOD FOR EVALUATING A NON-MEASURED OPERATING VARIABLE IN A REFRIGERATION PLANT

(75) Inventor: Claus Thybo, Soenderborg (DK)

(73) Assignee: Danfoss A/S, Nordborg (DK)

( * ) Notice: Subject to any disclaimer, the term of this patent is extended or adjusted under 35 U.S.C. 154(b) by 702 days.

(21) Appl. No.: 10/512,207

(22) PCT Filed: Apr. 12, 2003

(86) PCT No.: PCT/DK03/00252

§ 371 (c)(1),
(2), (4) Date: Mar. 28, 2005

(87) PCT Pub. No.: WO03/089855

PCT Pub. Date: Oct. 30, 2003

(65) Prior Publication Data

US 2005/0166608 A1 Aug. 4, 2005

(30) Foreign Application Priority Data

Apr. 22, 2002 (DE) ..... 102 17 974

(51) Int. Cl.
*F25B 49/00* (2006.01)
*G01K 13/00* (2006.01)

(52) U.S. Cl. ..... 62/127; 62/129

(58) Field of Classification Search ..... 62/125, 62/127, 129, 126

See application file for complete search history.

(56) References Cited

U.S. PATENT DOCUMENTS 2,295,992 A 9/1942 Gonzalez et al.
3,171,462 A 3/1965 Reinhart, Jr.
3,707,851 A 1/1973 McAshan, Jr.

(Continued)

FOREIGN PATENT DOCUMENTS

CA 2344908 A1 1/2002

(Continued)

OTHER PUBLICATIONS

Richard W. Hamming, Calculus and the Computer Revolution, 1968, The Mathematical Association of AMerica, Inc., pp. 43-57.*

(Continued)

*Primary Examiner*—Marc E Norman
(74) *Attorney, Agent, or Firm*—McCormick, Paulding & Huber LLP

(57) ABSTRACT

Disclosed is a method for evaluating a non-measured operating variable in a refrigeration plant, which can be derived from at least one signal which is sensed at specific points in time, enabling early recognition of errors. An error indicator is formed by means of the following steps: a) the error indicator is set to a specified value at a first moment in time; b) a sum if formed from the error indicator of a predetermined earlier moment in time and a first variable derived from an estimated value for the operating variable taking into account at least one signal-dependent variable; c) the error indicator is set to the value of the sum if the sum is greater than the specified value, and set to the specified value if the sum is less than or the same as the specified value.

20 Claims, 3 Drawing Sheets

U.S. PATENT DOCUMENTS

| | | | | |
|---|---|---|---|---|
| 3,918,300 | A | 11/1975 | Weisstuch et al. | |
| 4,136,528 | A | 1/1979 | Vogel et al. | |
| 4,193,781 | A | 3/1980 | Vogel et al. | |
| 4,325,223 | A | 4/1982 | Cantley | 62/126 |
| 4,390,058 | A | 6/1983 | Otake et al. | 165/1 |
| 4,479,727 | A | 10/1984 | Domingorena et al. | 374/65 |
| 4,500,035 | A | 2/1985 | Kuroda et al. | |
| 4,510,576 | A | 4/1985 | MacArthur et al. | |
| 4,574,870 | A | 3/1986 | Weitman | |
| 4,611,470 | A | 9/1986 | Enstrom | 62/127 |
| 4,614,087 | A | 9/1986 | Nadamoto et al. | |
| 4,621,502 | A | 11/1986 | Ibrahim et al. | 62/223 |
| 4,729,667 | A | 3/1988 | Blangetti et al. | |
| 4,766,553 | A | 8/1988 | Kaya et al. | 364/506 |
| 4,768,346 | A | 9/1988 | Mathur | 62/127 |
| 4,885,914 | A | 12/1989 | Pearman | 62/129 |
| 5,079,930 | A | 1/1992 | Beaverson et al. | |
| 5,289,692 | A | 3/1994 | Campbell et al. | 62/181 |
| 5,341,649 | A | 8/1994 | Nevitt et al. | |
| 5,363,905 | A | 11/1994 | Rhiel et al. | |
| 5,457,965 | A | 10/1995 | Blair et al. | |
| 5,596,507 | A | 1/1997 | Jones et al. | |
| 5,615,733 | A | 4/1997 | Yang | 165/11.1 |
| 5,623,426 | A | 4/1997 | Ozawa et al. | 364/557 |
| 5,689,963 | A | 11/1997 | Bahel et al. | 62/129 |
| 6,089,033 | A | 7/2000 | Dube | |
| 6,128,910 | A | 10/2000 | Faircloth | 62/129 |
| 6,223,544 | B1 * | 5/2001 | Seem | 62/127 |
| 6,225,907 | B1 | 5/2001 | Derryberry et al. | 340/584 |
| 6,272,868 | B1 | 8/2001 | Grabon et al. | 62/125 |
| 6,330,802 | B1 | 12/2001 | Cummings et al. | |
| 6,460,358 | B1 | 10/2002 | Hebert | |
| 6,543,238 | B2 | 4/2003 | Yamanaka et al. | |
| 6,590,362 | B2 * | 7/2003 | Parlos et al. | 318/799 |
| 2002/0055358 | A1 | 5/2002 | Hebert | |
| 2002/0139128 | A1 | 10/2002 | Suzuki et al. | |
| 2003/0019221 | A1 | 1/2003 | Rossi et al. | 62/127 |
| 2003/0055603 | A1 | 3/2003 | Rossi et al. | |
| 2003/0156999 | A1 | 8/2003 | Knudsen et al. | |
| 2004/0144106 | A1 | 7/2004 | Douglas et al. | |
| 2005/0166609 | A1 * | 8/2005 | Thybo et al. | 62/126 |
| 2005/0172647 | A1 | 8/2005 | Thybo et al. | 62/129 |
| 2006/0032606 | A1 | 2/2006 | Thybo et al. | 165/11.1 |

FOREIGN PATENT DOCUMENTS

| | | |
|---|---|---|
| DE | 2451361 | 5/1976 |
| EP | 0155826 | 12/1990 |
| EP | 0453302 | 10/1991 |
| EP | 0 470 676 A2 | 12/1992 |
| EP | 0 518 035 B1 | 12/1992 |
| EP | 0 559 043 | 4/1996 |
| GB | 2062919 | 5/1981 |
| JP | 63071625 | 4/1988 |
| JP | 01174870 | 7/1989 |
| JP | 5264136 | 10/1993 |
| JP | 7234043 A | 2/1994 |
| JP | 2001255046 | 9/2001 |
| WO | WO 87/05097 | 8/1987 |
| WO | 02090832 | 11/2002 |

OTHER PUBLICATIONS

Wilbert F. Stoecker; Industrial Refrigeration Handbook; 1998; McGraw-Hill Companies, Inc.; pp. 55, 64-68.

Yunus A. Cengel; Michael A. Boles; Thermodynamics; Nov. 27, 2001; McGraw-Hill; 4th Edition; pp. 193-195.

Richard W. Hamming, Calculus and the Computer Revolution, 1968, The Mathematical Association of AMerica, Inc., pp. 43-57.

International Search Report for Serial No. PCT/DK03/00251 dated Jul. 14, 2003.

International Search Report for Serial No. PCT/DK03/00468 dated Sep. 16, 2003.

International Search Report for Serial No. PCT/DK03/00701 dated Jan. 26, 2004.

Yunus A. Cengel, Michael A. Boles, Thermodynamics, 1998, McGraw-Hill, 3rd Edition, pp. 214-217.

European Search Report issued for related application No. 03 757 722.8 dated Sep. 22, 2005, 3 pages.

* cited by examiner

METHOD FOR EVALUATING A NON-MEASURED OPERATING VARIABLE IN A REFRIGERATION PLANT

CROSS-REFERENCE TO RELATED APPLICATIONS

This application is entitled to the benefit of and incorporates by reference essential subject matter disclosed in International Patent Application No. PCT/DK03/00252 filed on Apr. 12, 2003 and German Patent Application No. 102 17 974.3 filed on Apr. 22, 2002.

FIELD OF THE INVENTION

The present invention concerns a method for the evaluation of a non-measured operating variable in a refrigeration plant, which variable is derivable from at least one signal which is sensed at predetermined points of time.

BACKGROUND OF THE INVENTION

For the control of refrigeration systems it is many times necessary to evaluate information from the refrigeration system. This information involves primarily temperature information. Possibly, however, one also wants to evaluate other information about pressures or the cooling medium—or air flows. Occasionally, information is also obtained indirectly, for example a pressure information from a temperature information. Such informations do not, however, serve only for the control of the refrigeration system, but also to recognize faults at the earliest possible time; that is so early that the goods cooled are not damaged. It is also beneficial to have a detection made at a point of time at which indeed no significant temperature increase has as yet set in, the refrigeration system, however, having become heavily loaded by a non-optimal operation.

The signals in a refrigeration system change only relatively slowly. It is therefore difficult to recognize a trend if the signals move in a range from which a fault could be indicated. Since the signals are determined by sensors which evaluate the involved physical values at predetermined points of time, or a permanently created signal is only sensed at predetermined times, it often happens that a signal course has a "high-frequency" curve shape, that is the average value of the signal in fact represents the physical value to be detected. The value is, however, partially represented by considerable bursts upwardly and downwardly, which further aggravates the evaluation. This is especially true if the signal is arrived at by a differential forming condition, especially by a temperature differential across a heat exchanger. The term "high frequency" is here naturally meant in a relative way. The frequency is high as measured against the speed of change of physical values, such as the temperature in a refrigeration system.

The invention has as its object to be able to detect a fault at an early time.

SUMMARY OF THE INVENTION

This object is solved in the case of a method of the previously mentioned kind in that one forms a fault indicator by the following steps:

a) the failure indicator is at a first point of time set to a pregiven value, b) a sum is formed from the failure indicator of a predetermined earlier time point and a first value derived from an estimated value, for the operating values under consideration, of at least one signal dependent value, and c) the failure indicator is set to the value of the sum if the sum is larger than the pregiven value and set to the pregiven value if the sum is smaller than or equal to the pregiven value.

In the case of this procedure, in the event that the signal or the associated physical values do not practically change, the failure indicator remains at the pregiven value, because one can assume from this that a signal even in the case of fluctuation as seen statistically will be distributed about the middle value. In contrast to a pure average value formation this procedure has the advantage that one can essentially better recognize a trend in the signal. Accordingly, an earlier detection of a fault is possible.

Preferably, the pregiven value is zero. The deviation from the zero value can be relatively simply recognized. The determination of the fault indicator becomes easier.

Preferably, for the formation of the sum the fault indicator of the last time point is used. The fault indicator is therefore actualized from sensing time point to sensing time point. This makes possible a rapid reaction time and permits, so to say, the fault indicator to be continuously formed.

Preferably, the estimated value is determined experimentally during a fault free operation of the refrigeration system. If the refrigeration system runs fault free over a predetermined timed interval, for example 100 minutes, then it can be assumed that a thereby determined average value is representative for a fault free operation. In further operation of the refrigeration system one can then use this estimated value to form the fault indicator.

In a preferred procedure a residual is used for the formation of the first derived value, which is formed by a difference between the estimated value and a therefrom derived second value and a signal dependent value. The estimated value for the therefrom derived second value, into the derivation of which signal dependent components can also enter, is then a so called output value, with which the signal dependent value is compared. The residual is then produced as the difference. In the undisturbed case the residual oscillates around the zero value, that is on average the residual has the value of zero. In the case of a fault, however, the signal dependent value with time comes to exceed the estimated value and in fact in general in one direction. Accordingly, the residual takes on a value different from zero which then shows in the fault indicator.

Preferably, the first derived value is formed from the difference of the residual and a predetermined reliability value, with the difference being multiplied by a proportionality constant. By way of this procedure one so corrects the residual that large fluctuations are permitted. The reliability value is at each sensing time point or at each time point of the evaluation drawn from the residual. Many times in fault free operation the situation arises that the derived value has a value smaller than zero. If the residual on the other hand over time becomes larger than the predetermined reliability value, then it is amplified in the fault indicator to signify a fault. If the absolute value of the residual is used, then one obtains a growth of the fault indicator even in the case of a residual which over time is too small.

Preferably, the values of a first media flow of a heat or coldness transport medium, especially an air mass flow, is used as the operating value. The air mass flow is an important value for the operation of the refrigeration system. For example it serves in the sales cooling chests to transport the actual "coldness" to the products to be chilled. Sales cooling chests are used in a supermarket to hold ready for sale cold or deep frozen products. To maintain these products at the desired low temperature an air stream is continuously or intermittently conducted over the supply space in which the products are arranged. The cold air then sinks partially into the supply space. A disturbance of the air stream can lead to considerable problems. In the worst case, sufficient coldness is no longer transported to the products so that their temperature rises. If one first detects a fault at this time point, it is too late. The products are then very often already spoiled. Therefore, here an early recognition of the fault is of special significance. An early detection is, however, also of advantage because one can then avoid an overloading of the refrigeration system. If for example the evaporator is subjected to the deposit of ice and thereby only a reduced heat transfer from the cooling medium to the air is possible, one will be in fact be able over a given time interval to still transfer sufficient cooling capacity to the air. The refrigeration system must, however, work at a higher power which can have a disadvantageous effect on the service life and on the operational reliability. The same thing is also true if one of several fans, which drive the air through an air channel and over the products to be cooled, fails. The remaining fans are generally in the position to drive air in sufficient amount to cool the product. The blowers, however, are unproportionally heavily loaded because they are more often or longer put into operation. If one is able therefore to early detect a disturbance of the air flow and to create a fault report, such problems will appear only in a reduced number.

Here it is preferred that the value of the first media flow is calculated from a heat transfer between the first media flow and a second media flow of a heat or coldness carrier in a heat exchanger. In this case it is assumed that the heat which in the first media flow, for example taken from the air, is transferred entirely to the second media flow, for example the cooling medium in the heat exchanger. If one determines the heat content of the cooling medium in front of and behind the heat exchanger, one can from this calculate the mass per unit time of the through flowing air, if one knows the enthalpy differential of the air across the heat exchanger.

Preferably, the second derived value is the change in the enthalpy of the first media flow across the heat exchanger. The enthalpy of the first media flow permits a statement about the heat content of the first media flow. If the change of enthalpy is determined, then one determines the change of the heat content across the heat exchanger. Since this heat content is to be entirely given off to the second media flow, for example to the cooling medium, one can obtain therefrom the necessary information about the operating values of the first media flow, for example the air flow.

Preferably, the signal dependent value is the change of the enthalpy of the second media flow across the heat exchanger. As done above, it is assumed that the heat which is taken from the first media flow in the heat exchanger is entirely transferred to the second media flow. If the change of the enthalpy of the second media flow is determined, then one also obtains information about the change in the enthalpy of the first media flow.

Preferably, for the determination of the enthalpy of the second media flow a mass flow and a specific enthalpy differential of the second media flow across the heat exchanger is determined. The enthalpy is the product of the mass flow and of the specific enthalpy differential. The specific enthalpy differential is gotten from the specific enthalpy of the second media flow, for example the cooling medium, in front of and behind the heat exchanger. The specific enthalpy of a cooling medium is a material and condition characteristic and varies from cooling medium to cooling medium. Manufacturers of cooling mediums as a rule make available so called log p, h-diagrams for each cooling medium. By way of such diagrams the specific enthalpy of the cooling medium can be determined. For this one needs the temperature and the pressure at the expansion valve inlet. These values can be obtained with the help of a temperature sensor or a pressure sensor. The specific enthalpy at the evaporator output is obtained with the help of two measured values: one is the temperature at the evaporator outlet and the other is either the pressure at the evaporator outlet or the boiling temperature. The temperature at the evaporator outlet can be measured by a temperature sensor and the pressure at the evaporator outlet can be measured with a pressure sensor. Instead of the log p, h-diagrams one naturally can also use values which are set out in tables. This is very advantageous for an automatic calculation. In many cases the cooling medium manufacturer also makes available condition equations for the cooling medium.

Preferably, the second media flow is determined from a pressure differential across and the opening degree of an expansion valve. Especially in the case of system with electronically controlled expansion valves the through flow in many cases is proportional to the opening degree of the expansion valve. In the case of pulse width modulated expansion valve the opening degree corresponds to the opening duration. Additionally, the pressure differential across the valve and, as the case may be, the subcooling of the cooling medium at the valve inlet is needed. In the case of most systems these values stand available, because pressure sensors are available which measure the pressure in the condenser or liquifier and the pressure in the evaporator. The subcooling in many cases is ignorable and therefore does not especially need to be measured. The mass flow of the cooling medium through the valve can be calculated with the help of a valve characteristic, the pressure differential and the opening degree or the opening duration.

Alternatively or additionally to this one can determine the second media flow from the operating data and a difference of the absolute pressure across a compressor together with the temperature at the inlet of the compressor. As to the operating data, this concerns for example the rotational speed and/or the driving performance of the compressor.

BRIEF DESCRIPTION OF THE DRAWINGS

The invention is described in the following in more detail by way of a preferred embodiment in combination with the drawings. The drawings are.

DETAILED DESCRIPTION OF THE PREFERRED EMBODIMENTS

Figure 1:
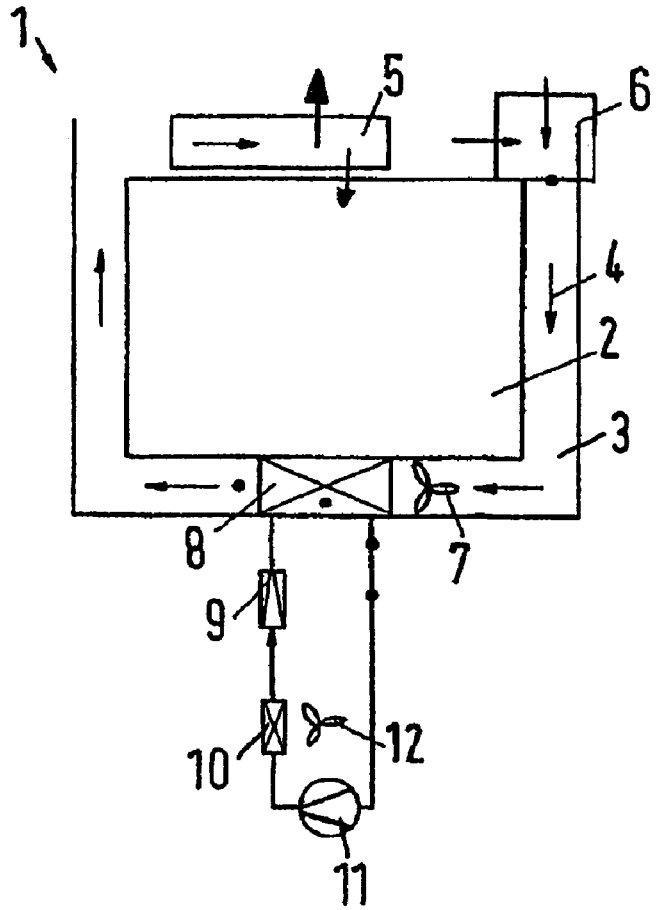
FIG. 1 is a schematic view of a refrigeration system.

FIG. 1 shows schematically a refrigeration system 1 in the form of a low temperature sales chest, such as used for example in supermarkets for the sale of refrigerated or frozen foods. The refrigeration system 1 has a storage space 2, in which the foods are stored. An air channel 3 passes around the storage space 2, that is it is located along both sides and the bottom of the storage space 2. An air flow 4 which is indicated by the arrow, after passing through the air channel 3 moves into a cooling zone 5 located above the storage space 2. The air is then again delivered to the entrance of the air channel 3 at which is located a mixing zone 6. In the mixing zone the air stream 4 is mixed with ambient air. In this way compensation is made for the cooled air which moves into the storage space 2 or which otherwise disappears into the surroundings.

A blower arrangement 7 is arranged in the air channel 3, which arrangement can be formed by one or more fans. The blower arrangement 7 provides that the air flow 4 in the air channel 3 can be moved. For the purposes of the following description it will be assumed that the blower arrangement 7 so drives the air stream 4 that the mass of air which is moved through the air channel 3 per unit of time is constant, so long as the blower arrangement 7 is running and the system operates faultlessly.

In the air channel 3 is arranged an evaporator 8 having a cooling medium circuit. The evaporator 8 has delivered to it through an expansion valve 9 cooling medium from a condenser or liquifier 10. The condenser 10 is supplied by a compressor or densifier 11 whose input in turn is connected with the evaporator, 8 so that cooling medium is circulated in a known way. The condenser 10 is provided with a blower 12, with the help of a which air from the surroundings is blown over the condenser 10 remove heat from the condenser.

The operation of such a cooling medium circuit is known in itself. In the system a cooling medium is circulated. That cooling medium leaves the compressor 11 as a gas under high pressure and having a high temperature. In the condenser 10 the cooling medium is liquified with the giving off of heat. After the liquification the cooling medium passes through the expansion valve 9 where it is depressurized. After the depressurization the cooling medium has two phases, that is liquid and gas. This two phase cooling medium is delivered to the evaporator 8. The liquid phase there evaporates by taking on heat, with the heat being taken from the air stream 4. After the remaining cooling medium has been evaporated the cooling medium will have been slightly more heated and comes out of the evaporator 8 as overheated gas. Then it is delivered to the compressor 11 and is there compressed.

One must now observe whether the air stream 4 can pass undisturbedly through the air channel 3. Disturbances for example can arise because the blower arrangement 7 has a defect and no longer delivers sufficient air. For example, in the case of a blower unit with several fans one of the fans can fail. The remaining fans can then indeed deliver a certain amount of air through the air channel 3 so that the temperature in the storage space 10 does not rise above a permitted value. However, the refrigeration system becomes heavily loaded which can lead to later damage. For example, elements of the refrigeration system, such as fans, are often brought into operation. Another case of failure is for example the icing up of the evaporator by moisture from the ambient air which precipitates on the evaporator.

In other words, one therefore wants to be in the position of being able to permanently monitor the amount of air which flows through the air channel 3 per unit of time. Such monitoring can take place at timed intervals, that is at sequential points of time which for example have timewise spacings in the size order of a minute. Above all, the determination of the mass per time unit of the air stream 4 with normal measuring devices is relatively expensive. One uses therefore an indirect measurement, in that one determines the heat content of the cooling medium which is taken on by the cooling medium in the evaporator 8.

For this the following consideration is a basis: the heat needed to evaporate the cooling medium is in the evaporator 8, which acts as a heat exchanger, taken from the air. Accordingly, the following equation is valid:

$$\dot{Q}_{Air}=\dot{Q}_{Ref} \tag{1}$$

wherein $\dot{Q}_{Air}$ is the heat actually taken from the air per unit of time and $\dot{Q}_{Ref}$ is the heat absorbed by the cooling medium per unit of time. With this equation one can determine the actual value for the mass flow, that is the mass per unit of time, for the air flowing through the air channel 3, if one can determine the heat absorbed by the cooling medium. One can then compare the actual mass flow of the air with a desired value. If the actual value does not agree with the desired value, this is then interpreted as a fault, that is as an impaired air stream 4. A corresponding fault announcement for the system can then be given.

The basis for the determination of $\dot{Q}_{Ref}$ is the following equation:

$$\dot{Q}_{Ref}=\dot{m}_{Ref}(h_{Ref,out}-h_{Ref,in}) \tag{2}$$

wherein $\dot{m}_{Ref}$ is the cooling medium mass per unit of time which flows through the evaporator, $h_{Ref,out}$ is the specific enthalpy of the cooling medium at the evaporator outlet, and $h_{Ref,in}$ is the specific enthalpy at the expansion valve inlet.

Figure 2:
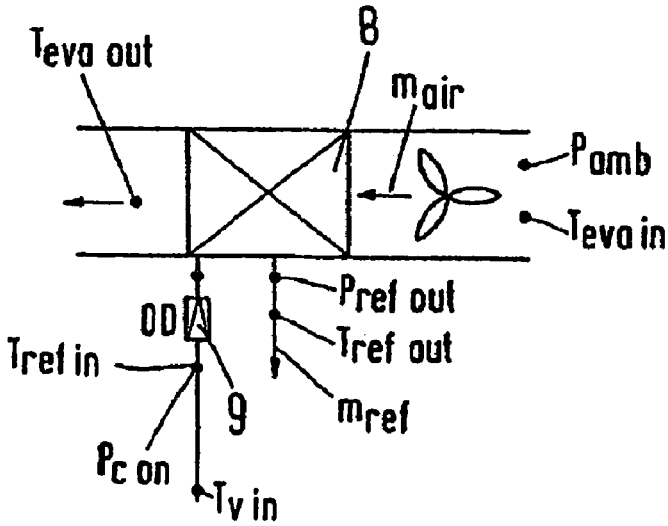
FIG. 2 is a schematic view with an illustration of values around a heat exchanger.

A specific enthalpy of a cooling medium is a material and condition property, which varies from cooling medium to cooling medium, but which is determinable for each cooling medium. Cooling medium manufacturers therefore usually make available so called log p, h-diagrams for each cooling medium. Through the use of these diagrams a specific enthalpy differential across the evaporator 8 can be determined. To determine for example $h_{Ref,in}$ with such a log p, h-diagram, one needs only the temperature of the cooling medium at the expansion valve inlet ($T_{Ref,in}$) and the pressure at the expansion valve inlet ($P_{Con}$). These quantities can be measured with the help of a temperature sensor or pressure sensor. The measuring spots are schematically illustrated in FIG. 2.

To determine the specific enthalpy at the evaporator outlet one needs to measure two values: the temperature at the evaporator outlet ($T_{Ref,out}$) and either the pressure at the outlet ($P_{Ref,out}$) or the boiling temperature ($T_{Ref,in}$). The temperature at the outlet ($T_{Ref,out}$) can be measured with a temperature sensor. The pressure at the outlet of the evaporator 8 ($P_{Ref,out}$) can be measured by a pressure sensor.

Instead of the log p, h-diagram one can naturally also use tabulated values which simplify the calculation with the help of a computer. In many cases the cooling medium manufacturers also make available equations of state or condition for the cooling mediums.

The mass flow of the cooling medium ($\dot{m}_{ref}$) can alternatively be determined by a flow meter. In the case of systems with electronically controlled expansion valves, which are driven with pulse width modulation, it is possible to determine the mass flow $\dot{m}_{Ref}$ from the degree of opening or the opening duration, if the pressure difference across the valve and the subcooling at the input to the expansion valve 10 ($T_{Vin}$) is known. In most systems this is the case, since pressure sensors are available for measuring the pressure in the condenser 10. The subcooling is in many cases constant and evaluatable, and therefore does not have to be measured. The mass flow $m_{Ref}$ through the expansion valve 9 can be calculated with the help of a valve characteristic, the pressure difference, the subcooling and the degree of opening or the opening duration. With many pulse width modulated expansion valve 9 it has been seen that the mass flow $m_{Ref}$ is nearly proportional to the pressure difference and to the opening duration. In this case one can determine the mass flow by the following equation:

$$\dot{m}_{Ref}=k_{Exp}\cdot(P_{Con}-P_{Ref,out})\cdot OD \tag{3}$$

wherein $P_{Con}$ is the pressure in the condenser 10, $P_{Ref,out}$ is the pressure in the evaporator, OD is the opening duration and $k_{Exp}$ is a proportionality constant dependent on the valve. In many cases the subcooling of the cooling medium is so large that it is necessary to measure the subcooling, because the cooling medium flow through the expansion valve is influenced by the subcooling. In many other cases, however, one needs only the pressure difference and the degree of opening of the valve because the subcooling is of a fixed size for the cooling system and can then be obtained from a valve characteristic or by a proportionality constant. Another possibility for determining the mass flow $\dot{m}_{Ref}$ exists in evaluating the values of the compressor 11, for example the rotational speed of the compressor, the pressures at the compressor inlet and outlet, the temperature at the compressor inlet, and a compressor characteristic.

For the actual value of the heat removed from the air per unit of time, $\dot{Q}_{Air}$, principally the same equation can be used as that for the heat per unit of time emitted by the cooling medium;

$$\dot{Q}_{Air}=\dot{m}_{Air}(h_{Air,in}-h_{Air,out}) \tag{4}$$

wherein $\dot{m}_{Air}$ is the mass flow of air, $h_{Air,in}$ is the specific enthalpy of the air in advance of the evaporator and $h_{Air,out}$ is the specific enthalpy of the air following the evaporator.

The specific enthalpy of the air can be calculated with the help of the following equation:

$$h_{Air}=1.006\cdot t+x(2501+1.8\cdot t),[h]=\text{kJ/kg} \tag{5}$$

where t is the temperature of the air, therefore $T_{Eva,in}$ for the air in advanced of the evaporator and $T_{Eva,out}$ for the air following the evaporator. "x" is used to indicate the proportion of moisture in the air. The proportion of moisture in the air can be calculated by the following equation:

$$x = 0.62198\cdot\frac{P_w}{P_{Amb}-P_w} \tag{6}$$

Here $P_w$ is the partial pressure of the water vapor in the air and $P_{Amb}$ is the pressure of the air. $P_{Amb}$ can either be measured or one can used for this value simply a standard atmospheric pressure. The deviation of the actual pressure from standard atmospheric pressure plays no significant role in the calculation of the amount of heat emitted from the air per unit of time. The partial pressure of the water vapor is determined by the relative humidity of the air and the partial pressure of the water vapor in saturated air and can be calculated from the following equation:

$$P_w=P_{w,Sat}\cdot RH \tag{7}$$

Here RH is the relative humidity of the air and $P_{w,Sat}$ is the partial pressure of the water vapor in saturated air. $P_{w,Sat}$ is dependent only on the air temperature and can be found in thermodynamic reference works. The relative humidity of the air RH can be measured or one can use typical values in the calculation.

If equations (2) and (4) are set equal to one another as in equation (1), the result is:

$$\dot{m}_{Ref}(h_{Ref,out}-h_{Ref,in})=\dot{m}_{Air}(h_{Air,in}-h_{Air,out}) \tag{8}$$

From this the actual air mass flow $\dot{m}_{Air}$ can be found, by separating out $\dot{m}_{Air}$ as follows:

$$\dot{m}_{Air} = \dot{m}_{Ref}\frac{(h_{Ref,out}-h_{Ref,in})}{(h_{Air,in}-h_{Air,out})} \tag{9}$$

This actual value for the air mass flow $\dot{m}_{Air}$ can then be compared with a desired value, and in the case of a substantial difference between the actual value and the desired value the operator of the refrigeration system can be made aware by way of a failure signal that the system is not running in an optimal manner.

In many cases it is recommendable that the desired value for the air flow in a system be determined. For example, this desired value can be determined as the average value over a given interval of time, during which the system runs under stable and fault free operating conditions. One such time interval can for example be 100 minutes.

A certain difficulty arises above all in that the signals produced by the individual sensors are subject to considerable fluctuations. These fluctuations can be quite opposite to one another so that for the value of $\dot{m}_{Air}$ a signal is obtained which poses certain difficulties for the evaluation. These fluctuations are a result of the dynamic relationships in the refrigeration system. Therefore, it can be beneficial, instead of the equation (9) in regularly spaced timed intervals, for example once per minute, to calculate a value which in the following is referred to as "residual":

$$r = \bar{\dot{m}}_{Air}(h_{Air,in}-h_{Air,out})-\dot{m}_{Ref}(h_{Ref,out}-h_{Ref,in}) \tag{10}$$

$$\bar{\dot{m}}_{Air}$$

is an estimated value for the air mass flow under faultless operating conditions. Instead of an estimate one can also use a value which is determined as the middle value over a given time interval from equation (9).

In a system, which runs faultlessly, the residual should give an average value of zero, even though it is actually subject to considerable fluctuations. In order to be able to recognize early a fault indicated by a tendency of the residual, one assumes that the determined value for the residual is normally distributed about an average value and indeed is independent of whether the system operates faultlessly or whether a fault has appeared. One calculates then a fault indicator $S_i$ according to the following relationship:

$$S_i = \begin{cases} S_{i-1}+s_i, \text{ if } S_{i-1}+s_i > 0 \\ 0, \text{ if } S_{i-1}+s_i \le 0 \end{cases} \tag{11}$$

where $S_i$ can be calculated by means of the following equation:

$$s_i = k_1\left(r_i - \frac{\mu_0 + \mu_1}{2}\right) \tag{12}$$

Here it is naturally assumed that the fault indicator $S_1$, that is for the first point of time, has been set to zero. For a later point of time one uses $s_i$ from equation (12) and forms the sum of this value with the fault indicator $S_i$ from an earlier point of time. If this sum is larger than zero, a fault indicator is reset to this new value. If this sum is equal to or smaller than zero the fault indicator is reset to zero. In equation (12) $k_1$ is a proportionality constant. $\mu_0$ can in the most simple case be set to the value zero. $\mu_1$ is an estimated value which for example can be derived in that one creates a fault and determines the average value of the residual with this fault. The value $\mu_1$ is a criterium for how often one has to accept a false alarm. The two μ-values are therefore also called reliability values.

When for example a fault occurs because a fan of the blower arrangement 7 does not run, then the fault indicator $S_i$ will become larger, because the periodically determined value of the residual $r_i$ on average becomes larger than zero. When the failure indicator reaches a predetermined value an alarm is activated which indicates that the air circulation has shrunken. If $\mu_1$ is made larger fewer fault alarms are made, however, also at the risk of a later discovery of a fault.

Figure 3:
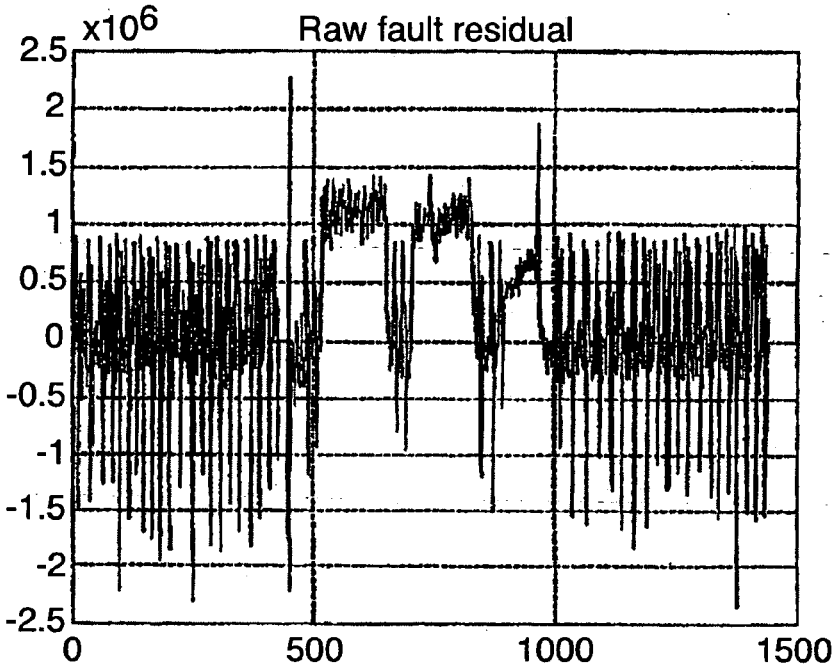
FIG. 3 is an illustration of a residual in a first case of fault.
Figure 4:
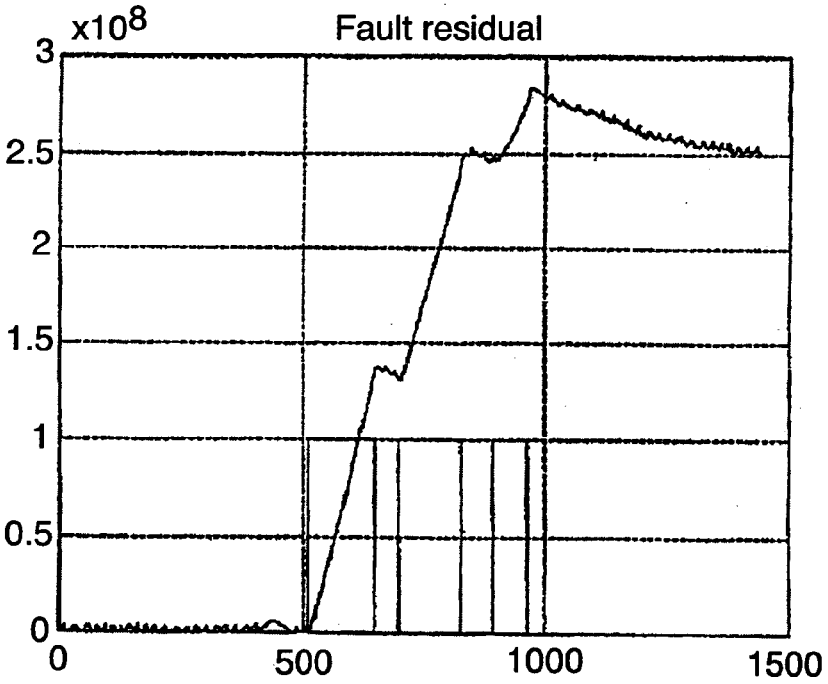
FIG. 4 illustrates the course of a fault indicator for the first case of fault.

The mode of operation of the filtering according to equation (11) will now be explained in connection with FIGS. 3 and 4. In FIG. 3 time is represented to the right in minutes and the residual r is represented vertically. Between t=510 and t=644 minutes one fan of the blower arrangement 7 has failed. This makes itself felt by an increased value of the residual r. This increase is indeed already to be recognized in FIG. 3. A better recognition possibility exists, however, if one observes the failure indicator $S_i$, the course of which is illustrated in FIG. 4. Here the failure indicator $S_i$ is represented upwardly and the time t in minutes toward the right. The failure indicator therefore rises continuously in the time between t=510 minutes and t=644 minutes. One can, for example, upon the exceeding of the value $S_i$ of $0.2\times10^8$ activate an alarm.

In the time between t=700 and t=824 minutes is likewise a fan of the blower arrangement 7 shut down. The failure indicator $S_i$ increases further. Between these two disturbances happenings both fans are again active. The fault indicator $S_i$ is therefore lowered, but does not fall back to zero. The fault indicator $S_i$ is reliably increased in the case of failure. In the time from 0 to 510 minutes the fault indicator $S_i$ moves in the region of the zero point. The fault indicator $S_i$ would again move back to zero if the system were to run fault free for a long enough period of time. In practice one will of course set the failure indicator $S_i$ to zero when a failure has been corrected.

Figure 5:
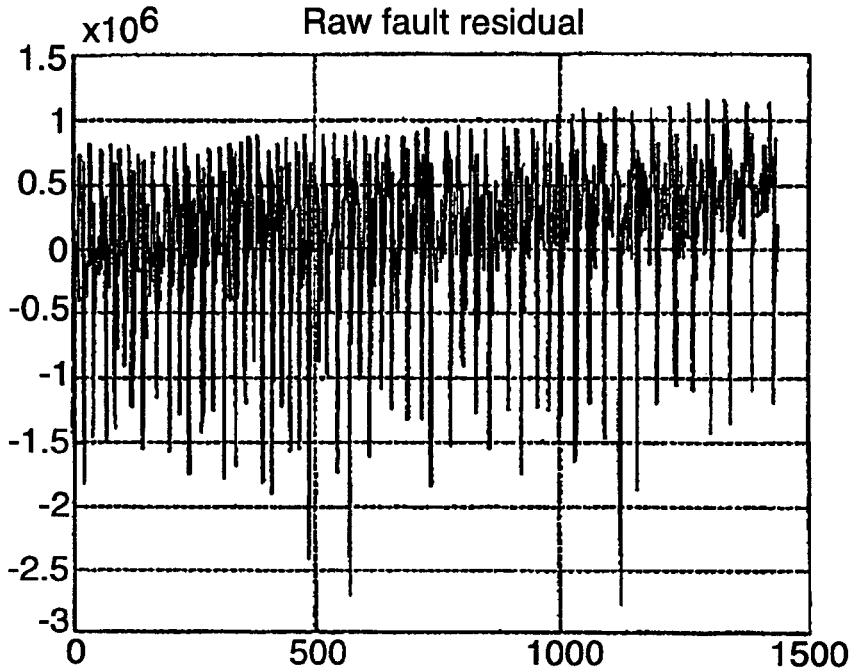
FIG. 5 illustrates the course of the residual for a second case of fault.
Figure 6:
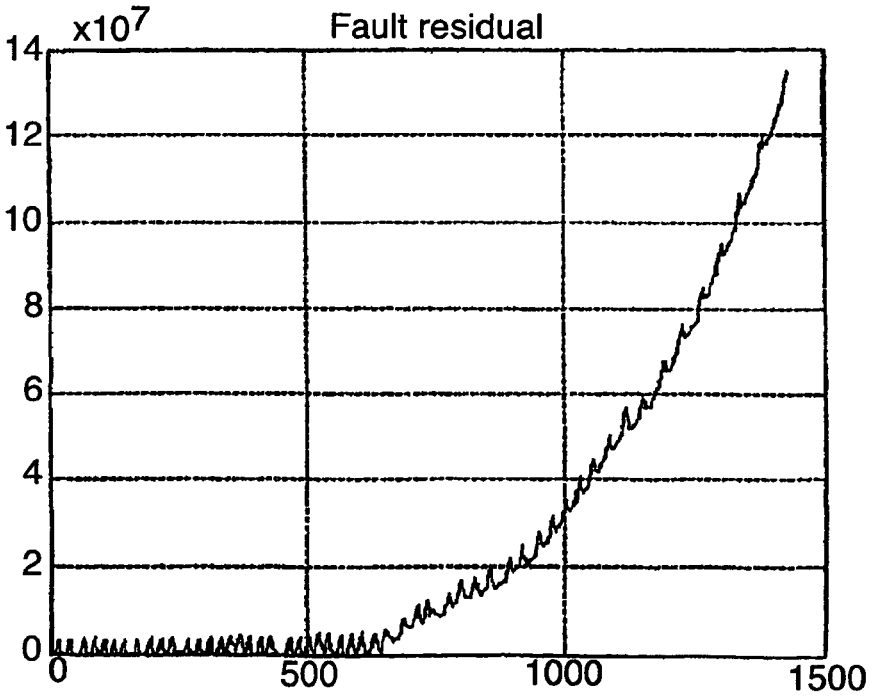
FIG. 6 is an illustration of the fault indicator for the second case of fault.

FIGS. 5 and 6 show the development of the residual r and the development of the fault indicator $S_i$ in the case were the evaporator 8 slowly ices up. Here in FIG. 5 the residual r and in FIG. 6 the fault indicator $S_i$ is represented upwardly, while the time t is represented to the right in minutes.

In FIG. 5 it is to be recognized that the middle value of the residual r gradually rises. It is especially to be likewise recognized that this increase as needed for a fault announcement of necessary reliability is to be obtained quantitatively only with difficulty. At t=600 minutes a beginning of an icing up of the evaporator 8 appears. First at t=1200 minutes can one detect such icing up by way of a reduced performance of the refrigeration system.

If for example one sets the boundary value for the fault indicator to $1\times10^7$, then a fault would be discovered already at about t=750 minutes, therefore essentially earlier, then by a reduced performance of the system.

The method can also be used to start a defrosting process. The defrosting process would then be started if the fault indicator $S_i$ reaches a predetermined value.

Advantageously, with this process an early discovery of failures, without using more sensors than in a typical system, is available. The faults are discovered before they create high temperature in the refrigeration system. Also, faults are discovered before the system no longer runs optimally, if one takes the required energy as the measure of it.

Illustrated is the control of the air flow at the evaporator 8. Obviously, one can carry out a similar control at the condenser 10. In this case the calculations are even simpler, because no moisture is taken from the ambient air when the air passes through the condenser 10. Accordingly, no water condenses from the air at the condenser 10, because this is warmer. A disadvantage in the case of using the method at the condenser 10 is that two additional temperature sensors are necessary for measuring the temperature of the air in front of and behind the condenser.

The method described has been for the case where the air flow is constant and adaption to different refrigeration requirements is achieved in that the air flow is intermittently created. It is, however, in principal also possible, within certain limits to permit a variation of the air stream, if one additionally makes reference to the driving power or to the rotational speed of the blower.

The method for detecting changes in the first media flow can also be used in the case of systems which operate with an indirect cooling. In the case of such systems one has a primary media flow, in which the cooling medium is circulated, and a secondary media flow, wherein a cooling agent, for example brine, circulates. In the evaporator the first media flow cools the second media flow. The second media flow then cools for example the air in a heat exchanger. One can not only use this method at the evaporator but also at the air/cooling agent heat exchanger. At the air side of the heat exchanger the calculations do not change. The enthalpy increase can, if the cooling agent is not subjected to an evaporation process in the heat exchanger but only to a temperature increase, be calculated with the following formula:

$$Q_{KT}=c\cdot m_{KT}(T_{after}-T_{before}) \tag{13}$$

wherein c is the specific heat capacity of the brine $T_{after}$ is the temperature behind the heat exchanger, $T_{before}$ is the temperature in front of the heat exchanger, and $m_{KT}$ is the mass flow of the cooling agent. The constant c can be found in reference works, while the two temperatures can be measured, for example, with temperature sensors. The mass flow $m_{KT}$ can be determined by a mass flow measurer. Other possibilities are naturally also imaginable. $Q_{KT}$ then replaces the calculation $Q_{Ref}$ in the further calculations.

The invention claimed is:

1. A method for automatically defrosting a refrigeration plant evaporator, based on the evaluation of a non-measured operating variable in a refrigeration plant which variable is derivable from at least one signal, which signal is sensed at predetermined time points, wherein for the evaluation a failure indicator is formed by way of the following steps:

a) setting the failure indicator at a first point of time to a first pregiven value, b) forming a sum from the failure indicator of a predetermined earlier time point and a first value derived from an estimated value of the operating variable, under consideration of at least one signal dependent value, c) setting the failure indicator to the value of the sum if the sum is larger than the first pregiven value and setting the failure indicator to the first pregiven value if the sum is smaller than or equal to the first pregiven value, and d) starting an evaporator defrost based on comparison of the failure indicator to a second pre-given value.

2. The method according to claim 1, wherein the first pregiven value is zero.

3. The method according to claim 1, including that for forming the sum the failure indicator of the last time point is used.

4. The method according to claim 1, wherein the estimated value is experimentally determined during a fault free operation of the refrigeration plant.

5. The method according to claim 1, wherein for forming the first derived value a residual is used, which residual is formed by a difference between the estimated value or a second value derived therefrom and a signal dependent value.

6. The method according to claim 5, wherein the first derived value is formed from the difference of the residual and a predetermined reliability value, with the difference being multiplied by a proportionality constant.

7. The method according to claim 5, including the step of using the value of a first media flow of a heat or coldness transport medium, especially an air mass flow as the operating variable, wherein the second derived value is the change of the enthalpy of the first media flow across the heat exchanger.

8. The method according to claim 7, wherein the value of the first media flow is calculated from a heat transfer between the first media flow and a second media flow of a heat or coldness carrier in a heat exchanger, and wherein the signal dependent value is the change of the enthalpy of the second media flow across the heat exchanger.

9. The method according to claim 8, wherein for determining the enthalpy of the second media flow a mass flow and a specific enthalpy differential of the second media flow across the heat exchanger are determined.

10. The method according claim 9, wherein the second media flow is derived from a pressure differential across and an opening degree of an expansion valve.

11. The method according to claim 9, wherein the second media flow is determined from operating data and a difference of the absolute pressures across a compressor together with the temperature at the input of the compressor.

12. The method according to claim 1, including the step of using the value of a first media flow of a heat or coldness transport medium, especially an air mass flow as the operating variable.

13. The method according to claim 12, wherein the value of the first media flow is calculated from a heat transfer between the first media flow and a second media flow of a heat or coldness carrier in a heat exchanger.

14. A system for evaluation of a non-measured operating variable in a refrigeration plant, the system comprising:

one or more sensors producing signals indicative of conditions in said refrigeration plant; and a computer configured to receive said signals, to establish values dependent on said signals, and to form and evaluate an indicator, related to said non-measured operating variable, by way of the following steps:

setting the indicator at a first point of time to a first pregiven value, calculating a first value derived from an estimated value of said non-measured operating variable, under consideration of at least one signal dependent value, forming a sum from the indicator of a predetermined earlier time point and the first derived value, setting the indicator to the value of the sum if the sum is larger than the first pregiven value and setting the indicator to the first pregiven value if the sum is smaller than or equal to the first pregiven value, and comparing the indicator to a second pre-given value.

15. The system according to claim 14, wherein for forming said first derived value a residual is used, which residual is formed by a difference between said estimated value, or a second value derived therefrom, and a signal dependent value.

16. The system according to claim 15, wherein said first derived value is formed from the difference of said residual and a predetermined reliability value, with the difference being multiplied by a proportionality constant.

17. The system according to claim 15, wherein the value of a first media flow of a heat or coldness transport medium is used as said non-measured operating variable, and said second derived value is the change of the enthalpy of the first media flow across a heat exchanger.

18. The system according to claim 17, wherein the value of said first media flow is calculated from a heat transfer between said first media flow and a second media flow of a heat or coldness carrier in said heat exchanger, and wherein said signal dependent value is the change of the enthalpy of the second media flow across said heat exchanger.

19. The system according to claim 18, wherein for determining the enthalpy of said second media flow a mass flow and a specific enthalpy differential of said second media flow across said heat exchanger are determined.

20. The system according to claim 19, wherein the value of said second media mass flow is dependent on signals indicating a pressure differential across an expansion valve and an opening degree of the expansion valve.

* * * * *